US006886662B2

(12) United States Patent
Riley

(10) Patent No.: US 6,886,662 B2
(45) Date of Patent: May 3, 2005

(54) HANGING SCAFFOLD SUPPORT

(76) Inventor: D. Paul Riley, 145 South 720 West, Lehi, UT (US) 84043

( * ) Notice: Subject to any disclaimer, the term of this patent is extended or adjusted under 35 U.S.C. 154(b) by 0 days.

(21) Appl. No.: 10/666,111

(22) Filed: Sep. 18, 2003

(65) Prior Publication Data

US 2005/0072628 A1 Apr. 7, 2005

(51) Int. Cl.[7] ..... E04G 3/00

(52) U.S. Cl. ..... 182/82; 182/45; 182/150; 248/235

(58) Field of Search ..... 182/82, 27, 45, 182/119, 150; 248/235, 237, 240.3, 243

(56) References Cited

U.S. PATENT DOCUMENTS

| | | | | | |
|---|---|---|---|---|---|
| 132,583 | A | * | 10/1872 | Jester | 182/82 |
| 751,359 | A | | 2/1904 | Stronach et al. | 248/214 |
| 1,558,425 | A | | 10/1925 | Yetter | 182/150 |
| 2,121,704 | A | | 6/1938 | Leeworthy | 304/14 |
| 2,295,995 | A | * | 9/1942 | Lamb | 182/82 |
| 2,805,902 | A | * | 9/1957 | Von Drasek et al. | 182/82 |
| 2,882,101 | A | * | 4/1959 | Michalak et al. | 248/235 |
| 2,988,181 | A | * | 6/1961 | Darrey | 52/646 |
| 3,082,843 | A | * | 3/1963 | Leonard | 182/82 |
| 3,322,387 | A | | 5/1967 | Fortin, Sr. | 248/235 |
| 3,510,097 | A | | 5/1970 | McCaleb | 248/243 |
| 3,595,510 | A | | 7/1971 | Hutchinson | 248/235 |
| 3,776,498 | A | * | 12/1973 | Peters et al. | 248/219.1 |
| 4,068,446 | A | | 1/1978 | Brueske | 52/747 |
| 4,121,690 | A | | 10/1978 | Rawlings et al. | 182/45 |
| 4,122,916 | A | | 10/1978 | Strobel | 182/82 |
| 4,153,229 | A | | 5/1979 | Bequette | 248/240.3 |
| 4,452,336 | A | | 6/1984 | Sickler | 182/82 |
| 4,475,626 | A | | 10/1984 | Gleich | 182/150 |
| 4,497,389 | A | | 2/1985 | Whitlam et al. | 182/150 |
| 4,646,877 | A | | 3/1987 | Whan | 182/38 |
| 4,823,911 | A | | 4/1989 | Dore | 182/119 |
| 4,828,073 | A | | 5/1989 | Friday | 182/36 |
| 4,884,775 | A | | 12/1989 | Fischer et al. | 248/237 |
| 4,957,185 | A | | 9/1990 | Courchesne et al. | 182/150 |
| 4,971,169 | A | | 11/1990 | Fruth | 182/119 |
| 4,972,922 | A | | 11/1990 | Levine | 182/45 |
| D313,853 | S | | 1/1991 | Hutchins | D25/68 |
| D318,785 | S | | 8/1991 | Dean | D8/373 |
| 5,067,586 | A | | 11/1991 | Myers | 182/45 |
| 5,148,890 | A | | 9/1992 | Sipe | 182/45 |
| 5,259,477 | A | | 11/1993 | Fears et al. | 182/82 |
| 5,332,062 | A | | 7/1994 | Revere | 182/27 |
| 5,503,358 | A | | 4/1996 | Lapp | 248/235 |
| 5,601,154 | A | | 2/1997 | Eisenmenger | 182/45 |
| 5,678,654 | A | | 10/1997 | Uzawa | 182/150 |
| 5,829,549 | A | | 11/1998 | Flynn | 182/82 |
| 5,878,838 | A | * | 3/1999 | Lapp | 182/150 |
| 6,003,630 | A | * | 12/1999 | Whalen | 182/82 |
| 6,003,631 | A | * | 12/1999 | Knauth | 182/82 |
| 6,053,280 | A | | 4/2000 | Smith et al. | 182/82 |
| 6,752,243 | B1 | * | 6/2004 | Terzini | 182/92 |
| 2002/0003061 | A1 | * | 1/2002 | Philippe | 182/82 |
| 2002/0084141 | A1 | * | 7/2002 | Thomas | 182/82 |
| 2002/0139614 | A1 | | 10/2002 | Volkman | |
| 2004/0112675 | A1 | * | 6/2004 | Markovich | 182/82 |
| 2004/0159491 | A1 | * | 8/2004 | Albano | 182/82 |

* cited by examiner

*Primary Examiner*—Bruce A. Lev
(74) *Attorney, Agent, or Firm*—Pate Pierce & Baird

(57) ABSTRACT

A scaffold support system having an adjustable-width hanger. A vertical leg may support a foot upon which rests a deck, providing a working surface during building construction or modification. A lateral beam rests on a support structure forming part of the wall of a building with the vertical leg securing to the lateral beam at a plurality of points. A stop secured to the lateral beam to capture a support structure between itself and the vertical leg. The stop may be adjustable along the lateral beam to accommodate support structures of varying widths. An operator may insert the hanger from inside a building and pass the coupler through a gap between a frieze block and a top plate, presenting the coupler for securement to the vertical leg. A catch may slide along the foot into and out of engagement with an edge of the deck to prevent rotation of the deck.

10 Claims, 11 Drawing Sheets

HANGING SCAFFOLD SUPPORT

BACKGROUND

1. The Field of the Invention

This invention relates to supporting structures for use during construction, and more particularly to novel systems and methods for supporting decking for workmen above ground level in residential or other construction projects similar in nature.

2. The Background Art

Scaffolding has long been of both utility and concern in construction. In many states as well as in federal regulations, detailed specifications-of requirements apply to "riggers" and their craft. Scaffolding may be thought of as decking for supporting materiel, workmen, tools, and the like, above or below a common surface.

For example, a workman may stand on the ground while laying brick, working on certain woodwork, while wiring, and so forth. In construction of large, multi-storied buildings, special decking may be laid specifically for use during construction. Many feet above ground level, scaffolding built from the ground up becomes impractical. However, scaffolding may be used within a few stories' distance of the ground.

Scaffolding presents several problems. To provide proper structural strength, scaffolding is typically quite heavy. Moreover, special rigger licensing may be required for installation and use of scaffolding. In residential construction, the commitment of time and manpower for setting up and taking down scaffolding support may represent a substantial fraction of the task for which such scaffolding is set up in the first place.

Ladders are limited in their utility. Ladders must be moved frequently. Ladders may not be positionable readily both inside and outside the envelope of a building at all stages of construction where scaffolding may be useful or required. The weight, bulk, manpower, lack of flexibility in application, awkwardness in working indoors or in semi-finished areas, and the like add to the difficulty and expense of using conventional scaffolding.

What is needed is a simplified system for supporting workmen, tools, and materials, at a distance above ground level suitable to facilitate several common tasks. For example, decking suitable for working near a top plate of a residential construction wall is necessary. A support for decking positionable to support a workman installing soffits, fascia, installing trusses, and working on other projects that cannot readily be reached from the ground, is needed.

A support system is needed that is easily portable. A system that can be set up and taken down in a minimum amount of time, while occupying a minimum of space during storage and transport is needed. Such a system should also provide a means to resist theft given its ease of removal and portability. The system should also be capable of extending over a substantial working area upon deployment as needed. Likewise needed is a system that can be set up by a single workman and easily lowered to the ground when finished. Adjustability in height, length, distance from a bearing wall, and the like are preferable.

Preferably, such a system can hang from a top plate of a wall. It should adjust to a variety of widths of top plates. Simple removal from the top plate after closure of soffits, sheathing, Frieze blocks, and the like about walls and ceilings would be very useful. It would be of further utility to provide a system that is adjustable to accommodate a variety of top plate widths while at the same time not having an adjustment member that will not interfere with structures that may be present near the top plate. Such a system should also be positionable to rest on a top plate despite Frieze blocks, which are typically positioned between eaves and a top plate, leaving limited space to insert any support structure for a scaffold or the like.

A system is needed that does not require significant penetrations into a structure, and which can be used on both interior and exterior to a bearing wall of a house or other structure. A system that could be used even when a building in initial stages of framing, and yet during stages of semi-finished condition inside or outside a wall, would be beneficial. A system is needed that is easily operable (e.g. adjustable, carriable, deployable, etc.) with a single hand, or by a single user.

What is needed is a deck or scaffold support that can be climbed readily by some support mechanism in order to quicky adjust the height of a deck. A system that is fail safe, by virtue of, for example, being non-separable during adjustment, does not require multiple hands or adjustment, does not require precision alignments by a user, does not require eyes of a user to be located in a difficult position for adjustment, and does not require dismantling or removal in order to be adjusted, would be extremely efficient.

A system that provides for plank positioning close to and distanced from a wall, selectively at the choice of a user is needed. Such a system should be able to prevent tilting and twisting of the plank substantially regardless of the position or size of the plank. A system that can be folded down for ready-storage and transport with a minimum of fitting and assembly for use would be extremely handy and present an efficient use of manpower.

A deck or scaffold support is needed that provides simple adjustment of deck positions vertically and operational adjustment horizontally. The ability to work on open walls comprised merely of studs, or to work on closed walls, such as buildings being remolded, by taking advantage of openings for windows, and even perhaps to work on partially or fully covered walls, such as sided or bricked walls, would be preferred.

BRIEF SUMMARY OF THE INVENTION

An apparatus and method are disclosed generally describing a scaffold support having a leg extending in a more-or-less vertical or upright direction and provided with a lateral foot extendable therefrom. The lateral foot may be connected to the leg by a climber mechanism that supports the foot in operation, while simply and safely disengaging and readjusting the height of the foot along the leg. A working surface, such as a broad plank, or the like, may rest on the lateral feet of two or more scaffold supports to support a worker during construction of a building.

A hanger may secure the scaffold support to a wall or window sill. A lateral beam may project from the leg and rest on a support structure, such as the top surface or top plate of a wall or a window sill, during operation of the scaffold support. A stop may secure to the lateral beam and capture a supporting structure (e.g. wall) between the stop and the leg to prevent accidental slipping or release of the lateral beam from a support structure.

Both the leg and the stop may secure to the lateral beam at multiple positions along the lateral beam to provide variability of the distance between the stop and the leg to accommodate support structures of varying widths. The lateral beam may have registration structures formed along its length to allow this selective securement of the leg and stop to the lateral beam at different positions. The registration structures may be holes formed in the lateral beam and spaced apart from one another. The lateral beam may slide within apertures formed in the stop and leg. Locking pins may engage the stop and leg and the apertures in the lateral beam to fix the position of the stop and leg with respect to the lateral beam.

Alternative embodiments may position the lateral beam beneath a support structure. A spacer may secure a loading structure to the lateral beam, spaced apart therefrom. During normal operation, a support structure may be positioned between the lateral beam and the support structure. The spacer may secure at various positions along the lateral beam to further capture a support structure between the spacer and portions of the leg extending above a lateral beam.

In some modes of operation of a hanger, the hanger is removed from the leg in order to facilitate insertion of the hanger where Frieze blocks, or other roofing materials, hinder its insertion. A removable hanger may be inserted from the inside of a building with the leg positioned on the outside. An elongate coupler may secure to the lateral beam and be sized to fit between a gap between a Frieze block and a support structure. During operation, the coupler may be lowered through the gap and secured to the leg without requiring that the stop and lateral beam pass through the gap.

Structures may be provided to facilitate securement of a working surface to a scaffold support. A catch may secure at various points along the foot to secure an edge of the deck to prevent shifting or twisting. The catch may slidably secure to the foot and have a lock to fix the position of the catch relative to the foot. In some embodiments the catch is a notch positioned to engage a flange, or the like, forming part of a deck.

An edge of a deck may also be secured by an eye. The eye may have an aperture sized to receive a tether or cable for securing the apparatus against theft. A portion of the eye may extend over an edge of a deck (or flange of a beam of the deck) to prevent the edge from rising during use. In some embodiments, a scaffold support may be provided with both a catch and an eye. A deck may be positioned between the catch and the eye to restrain both edges of the deck and prevent shifting, tilting, and rotation of the deck. The adjustability of the catch may allow the deck to be laid on the foot and the catch subsequently brought into position to engage the deck. A second eye may be provided at an upper end of a leg to receive a rope, or the like, for raising and lowering of the scaffold support.

BRIEF DESCRIPTION OF THE DRAWINGS

The features and operation of the present invention will become more fully apparent from the following description, taken in conjunction with the accompanying drawings. Understanding that these drawings depict only typical embodiments of the invention and are, therefore, not to be considered limiting of its scope, the invention may be seen in additional specificity and detail in the accompanying drawings where.

DETAILED DESCRIPTION OF THE PREFERRED EMBODIMENT

It will be readily understood that the components of the present invention, as generally described and illustrated in the Figures herein, could be arranged and designed in a wide variety of different configurations. Thus, the following more detailed description of the embodiments of the system and method of the present invention, is not intended to limit the scope of the invention. The scope of the invention is as broad as claimed herein. The illustrations are merely representative of certain, presently preferred embodiments of the invention. Presently preferred embodiments of the invention will be best understood by reference to the drawings, wherein like parts are designated by like numerals throughout.

Figure 1:
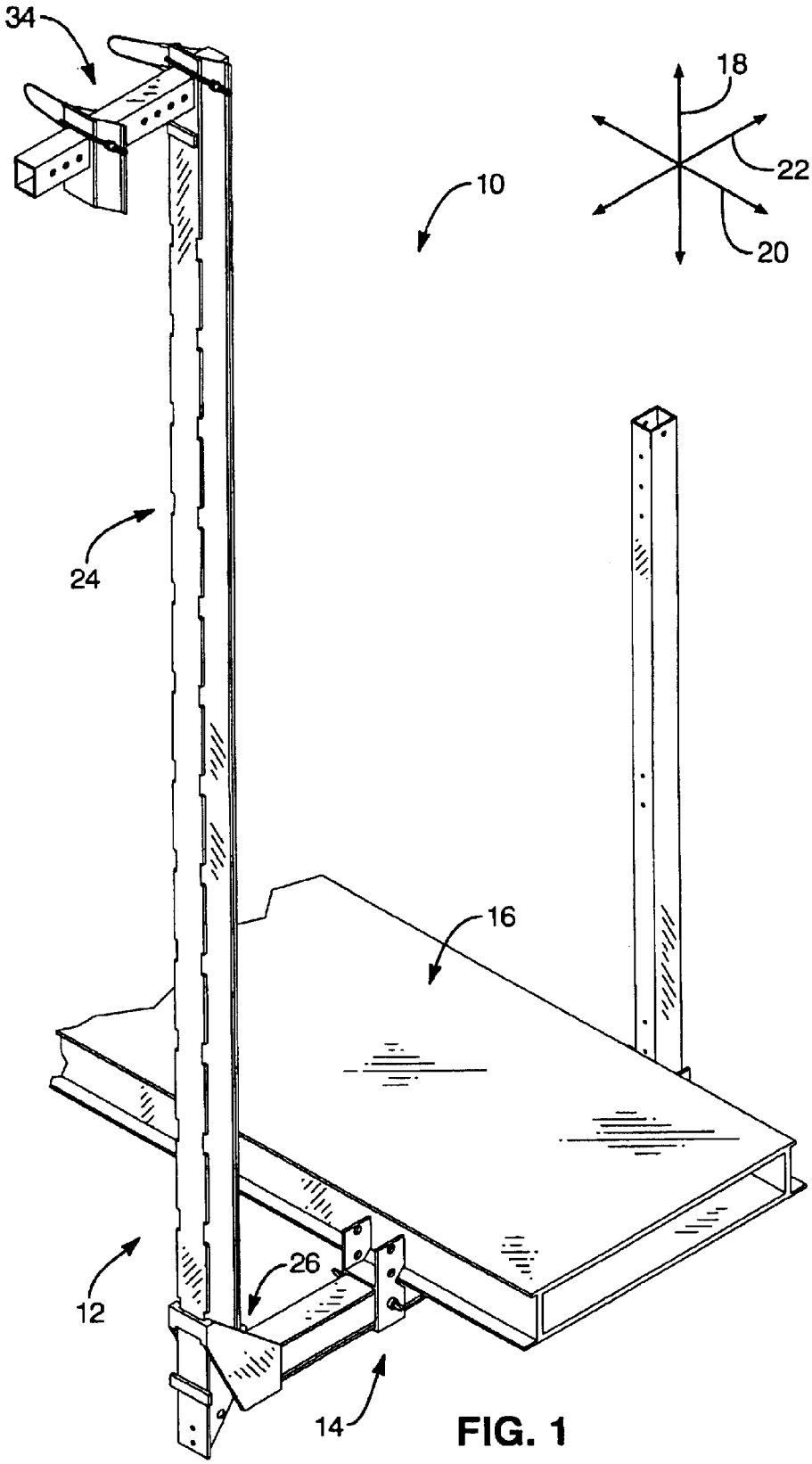
FIG. 1 is a perspective view of a scaffold support and working surface, in accordance with the invention.

Referring to FIG. 1, an apparatus 10 may include one or more scaffold supports 12 providing one or more bases 14 for supporting a work surface 16. The work surface 16 (or deck 16) may be embodied as a plank or planks made of wood, aluminum, ferrous alloy, or the like. A vertical (transverse) direction 18 may be defined as extending normal to the work surface 16. A horizontal (lateral) direction 20 and a longitudinal direction 22 may also be defined as being parallel to the work surface 16 and perpendicular to each other.

A leg 24 may support the base by means of a climber 26. The climber 26 may be permanently or removably attached to the base 14. The climber 26 may secure to the leg 24 at a number of positions to provide height adjustability. Height adjustability may enable a work surface 16 to be positioned suitably for a particular job. Adjustability may also enable scaffold supports 12 to hang on structures of differing heights and yet support a level work surface 16. A hanger 34 may transfer the weight of a scaffold support 12 to a supporting structure such as a window sill or the top of a wall.

Figure 2:
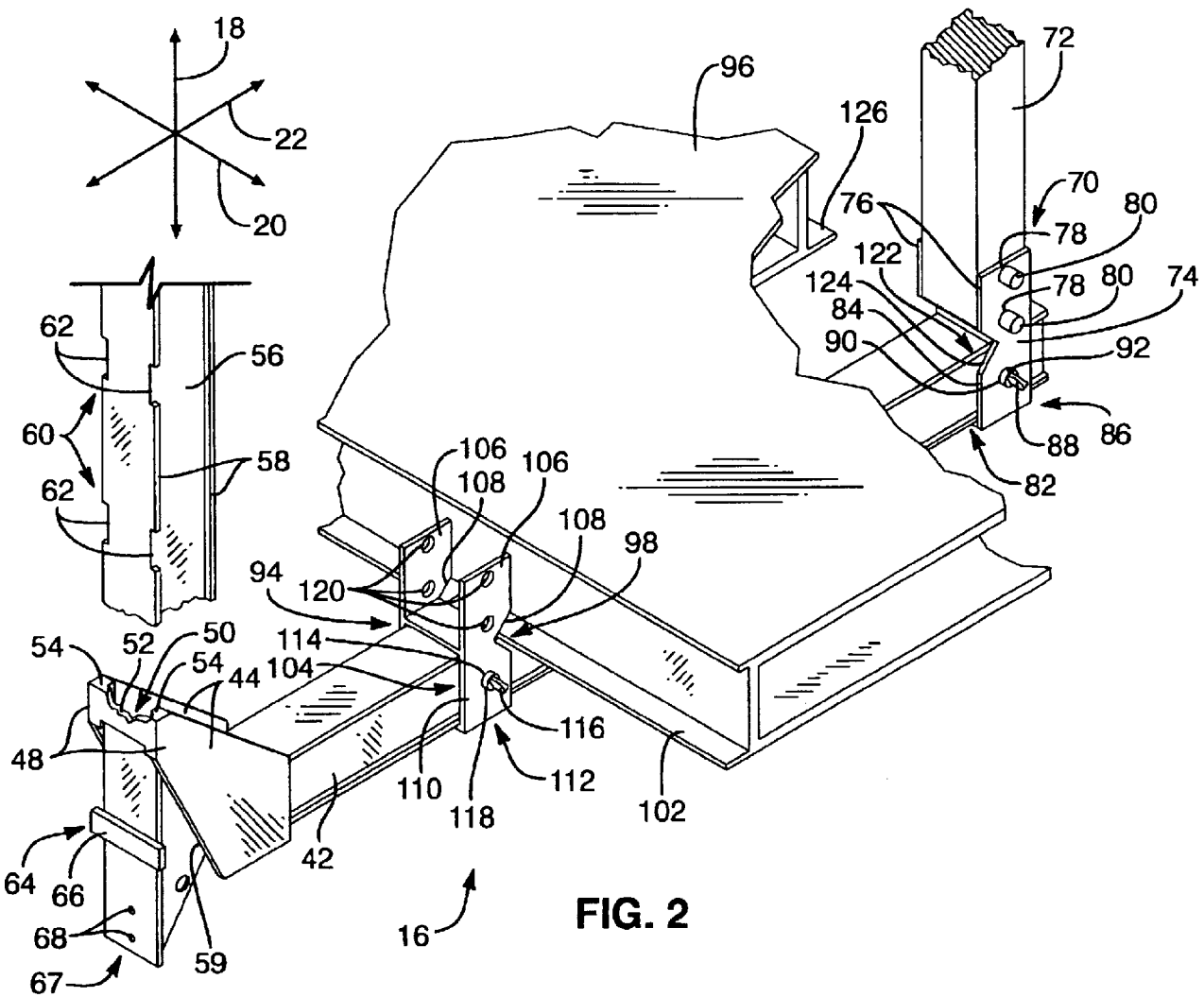
FIG. 2 is a partial cutaway perspective view of a base and climber in accordance with the invention.

Referring to FIG. 2, the base 14 may be a beam 42 having a substantially uniform cross section, such as an 'I' beam, box beam, or boxed 'I' beam having a hollow, square central portion with flanges at the corners. The climber 26 may have flanges 44, or other structures capable of bearing loads, secured to the beam 42 and extending beyond the near end 47 of the beam 42 a distance 46. The ends 48 of the flanges 44 may support a registration member 50, or registration members 50, for supporting fixing of the position of the beam 42 with respect to the leg 24.

A cross member 52 may serve as the registration member 50, fitting into a groove or other receptacle formed on the leg 24. In some embodiments, the cross member 52 may simply provide structural support to prevent distortion or separation of the flanges 44. The registration members 50 may be embodied as keys 54 formed, or secured, at the points of intersection of the flanges 44 with the cross member 52. The keys 54 may be short sections of square bars welded, or formed monolithically, at the inside corner of the intersection points. Alternatively, the keys 54 may be any protruding structure capable of insertion into a corresponding receptacle.

The leg 24 may be embodied as a beam 56 of substantially uniform cross section, such as an 'I' beam, box beam, or boxed 'I' beam. In embodiments of a beam 56 having an 'I' or boxed 'I' cross section, the beam 56 may have flanges 58 extending therealong. The leg 24 may extend through an aperture 59 formed by the conjoining of the flanges 44, cross member 52, and the beam 42. A number of registration structures 60 may be formed along the beam 56. The registration structures 60 may engage the registration member 50 secured to the base 14 to provide selective height adjustment. In some embodiments, the registration structures 60 may be grooves 62 sized to receive the keys 54. The grooves 62 may be formed in the flanges 58. Alternatively, the grooves 62 could be cut into a beam 42 without flanges 58, such as a box beam. Boxing rigidizes a beam, and places more material nearer the "outermost fiber" to support bending loads.

A safety stop 64 may be fixed to the leg 24 and be positioned below the climber 26 during normal operation of the apparatus 10 in the case of accidental disengagement of the registration structures from the registration members 50. In the illustrated embodiment, the safety stop 64 is a metal bar 66, but may be any structure capable of preventing passage of the climber 26 thereover, such as a post, protruding bolt, bolt head, or the like.

Added safety may result from securing the lower end 67 of the leg 24 to part of a wall to prevent it from swaying or tipping in any way that the hanger 34 may become disengaged from a wall or other support structure. In one embodiment, an aperture 68, or apertures 68, may be provided in the lower end 67 to receive a nail or other such fastener to secure the leg 24 to a structure forming part of a wall. Other securement means are possible, such as a rope, zip-tie, chain, cable, rigid hook, or the like.

Safety regulations in some geographic regions may require that scaffolding have a rail or bannister. Accordingly, a post mount 70 may secure to the beam 42 at or near the end 71 and may receive a post 72 for supporting a bannister or rail. The post mount 70 may include a bracket 74 for attaching to the base of a post 72. The bracket 74 may have flanges 76 each having at least one aperture 78 for receiving a locking pin 80 which may extend through both the flanges 76 and the post 72 positioned therebetween. Two locking pins 80 may be used to provide greater bearing length and prevent rotation of the post 72. Alternatively, the base of the post 72 may be positioned close enough to the beam 42 that interference of the post 72 with the beam 42 prevents rotation, and only a single locking pin 80 is needed. Any suitable mechanism for securing the base of a post 72 may be used, such as an aperture formed directly in the beam 42 into which the post 72 inserts. Alternatively, the post 72 may secure permanently to the post mount 70 with the post mount 70 being removable from the base 14.

The post mount 70 may include a slide 82 enabling the post mount to slide along the beam 42. The slide 82 may be embodied as an aperture 84, or channel 84, formed in, or secured to, the bracket 74. A lock 86 may fix the position of the slide 82 relative to the base 14. In some embodiments the lock 86 may be a set screw 88 threaded into an aperture 90 formed in the bracket 74. A threaded insert 92 may secure to the bracket 74 to provide greater bearing surface for the threads of the set screw 88.

A stop 94 may serve to restrain a work surface 16 against certain movements. For example, a plank 96 may be positioned between the post mount 70 and the stop 94, preventing movement of the plank 96 in the longitudinal direction 22. The stop 94 may include a catch 98 which may surround, or extend over, a portion of a work surface 16, such as a flange 102 of a plank 96. In some embodiments, the stop 94 may have a slide 104 slidably secured to the beam 42. The stop 94 may include a flange 106, or pair of flanges 106, with a catch 98 embodied as a notch 108, indentation 108, longitudinally extending arm 108, or the like, serving to restrain the edge 102 of a plank 96, or other structure making up the work surface 16. In one mode of operation the stop 94 may be slid away from the post mount 70, the work surface 16 positioned resting on the base 14, and the stop 94 slid toward the work surface 16 until the catch 98 is positioned to restrain the work surface 16. Thus, in embodiments where the catch 98 is a notch 108, the edge of a plank 96 may be positioned within the notch 108.

The slide 104 may be embodied as a bracket 110 substantially surrounding the beam 42. The bracket 110 may be formed integrally or monolithically with the flange 106 or flanges 106. A lock 112 may fix the position of the slide relative to the beam 42. In some embodiments, the lock 112 may be embodied as a threaded aperture 114 formed in the bracket 110 for receiving a set screw 116. In some embodiments, the bracket 110 may be made of relatively thin extruded aluminum. In such a case, a threaded insert 118 made of brass, or other suitably strong and smooth material (e.g. steel, plastic), may secure to the bracket 110 to receive the set screw 116 and increase the bearing surface between it and the bracket 110.

In some embodiments, the flanges 106 may have an aperture 120 or apertures 120 for stowage of the scaffold support 12. An aperture 120, or apertures 120, may receive a locking pin or the like, which may also extend through the leg 24 when positioned parallel to the base 14 for storage. The apertures 120 may also receive locking pins for securing a post 72 for supporting a rail, bannister, or the like. In still other embodiments, the post mount 70 may also include a catch 122 such as a notch 124, or the like, to secure the flange 126 of the plank 96.

Figure 3:
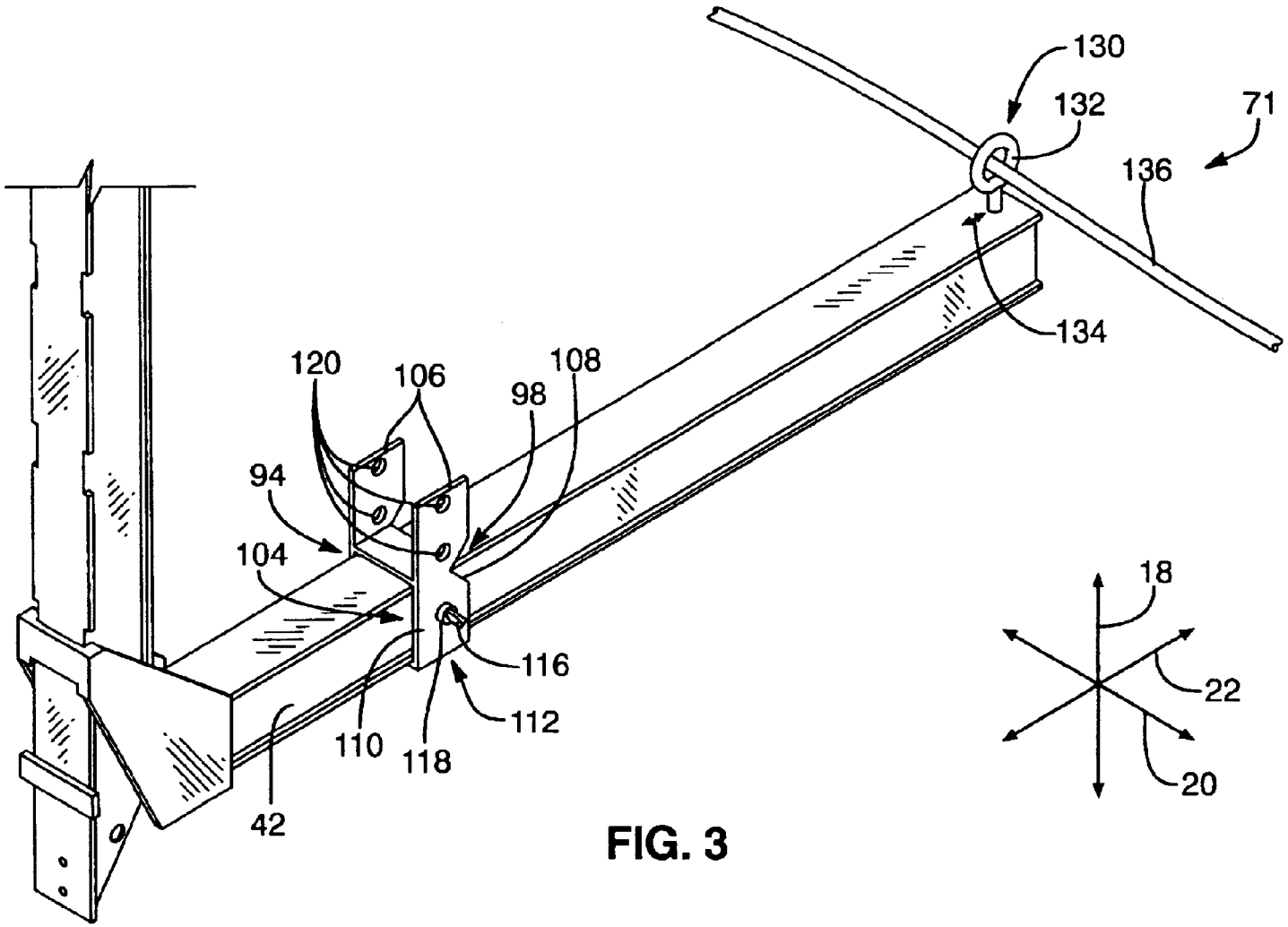
FIG. 3 is a perspective view of an alternative embodiment of a base in accordance with the invention.

Referring to FIG. 3, in some embodiments, an eye member 130 (or simply an eye 130) may be positioned near the far end 71 of the beam 42. The eye member 130 or fixture 130 may have an aperture 132 extending through the fixture 130 as the eye, accessible in a horizontal (lateral) direction 20 relative to the beam 42. The eye member 130 may extend a distance 134 in the longitudinal direction 22, relative to the beam 42, such that it extends over the work surface 16 or a portion of the beam underlying a working deck. The extension of the eye 130 over the work surface 16 (or supporting beam thereunder) may resist rotation of the work surface 16.

The aperture 132 of the eye 130 may receive a tether 136, such as a chain, cable, or the like. The tether 136 may be part of an anti-theft device or a redundant safety system. In some embodiments, two or more scaffold supports 12 may be tethered together through eyes 130. The eye member 130 may be an eye bolt 130 screwed into, or bolted to, the beam 42. Alternatively, the eye 130 may be welded to the beam 42 or secured by another adequately strong means.

Figure 4:
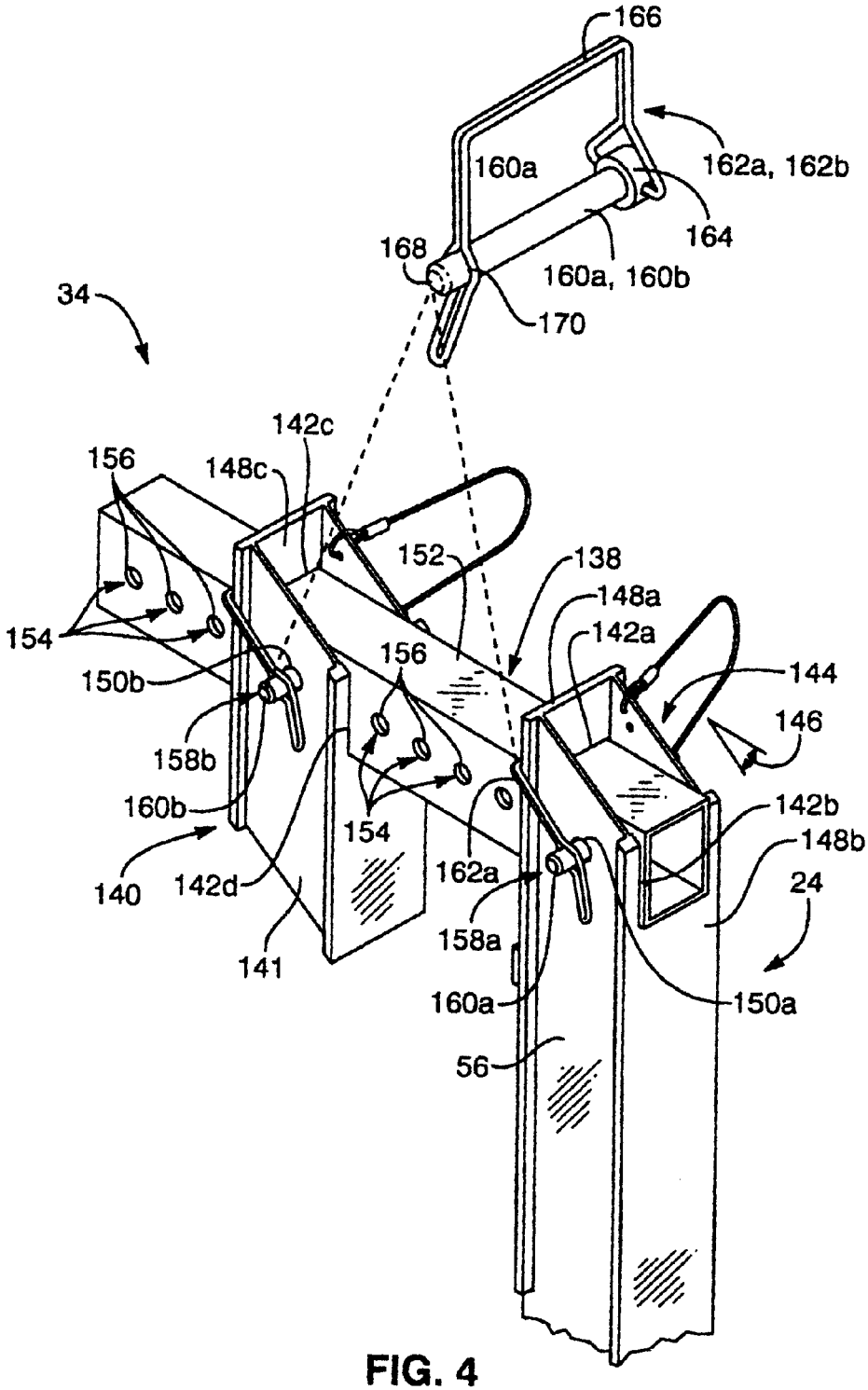
FIG. 4 is a perspective view of a hanger in accordance with the invention.

Referring to FIG. 4, a hanger 34 may transfer the weight of an apparatus 10 to a support structure, such as the top plate of an unfinished wall. Walls may have varying widths. A hanger 34 may need to be adjustable to accommodate walls of varying widths. Furthermore, the top plate of an unfinished wall is typically near the roof of a building. Accordingly, rafters, soffits, fascia, and Frieze blocks forming the roof may restrict the amount of space available to accommodate the hanger 34.

In some embodiments, a hanger may have a lateral support 138 that secures to the leg 24 and may rest directly on a support structure such as the top plate of a wall. The leg 24 may secure to the lateral support 138 at a variety of positions to provide adjustability. A stop 140 may secure to the lateral support 138 to prevent the lateral support 138 from slipping off a support structure. The stop 140 may be embodied as a short beam 141, such as a box beam, 'I' beam, or boxed 'I' beam.

Various mechanisms are suitable to enable variable positioning of the stop 140 and leg 24 along the lateral support 138. In one embodiment, the leg 24 may have an aperture 142*a* formed therein and sized to permit insertion of the lateral support 138 without excessive play. In some embodiments, the upper end 144 of the beam 56 forming the leg may be cut at an angle 146. The lateral support 138 may extend through an aperture 142*a* formed in wall 148*a* of a beam 56 embodied as a boxed 'I' beam 56 and through an open ended notch 142*b*, or closed aperture 142*b*, in wall 148*b*. Using an open ended notch 142*b* enables one to use less precision in, for example placing a locking aperture 150*a* for receiving a locking pin, inasmuch as it is much easier to establish a line (the lateral support 138) through two points (the position of the aperture 142*a* and the position of the locking aperture 150*a*) than through three points (the position of the aperture 142*a* in the wall 148*a*, the position of the locking aperture 150*a*, and the position of the aperture 142*b* in the wall 148*b*).

In some embodiments, the lateral support 138 may be a bar 152 made of square tubular steel, or the like. Any cross section may be suitable for the bar 152, provided it delivers adequate structural strength. In the hanger 34 of FIG. 4 the bar 152 has at least one surface that may rest on a support structure without causing excessive damage. The bar 152 may have a number of registration surfaces 154 that can be readily gripped or engaged to fix the location of the bar 152 relative to the leg 24, stop 140, or both. For example, the registration surfaces 154 may include grooves, notches, protruding posts, knobs, or the like. In the illustrated embodiment, the registration surfaces 154 are embodied as a series of apertures 156 spaced apart along the length of the bar 152.

A lock 158*a* may secure the lateral support 138 to the leg 24. The lock 158*a* may be embodied as a bolt, pin, or other elongate structure with a portion thereof having a uniform cross section. In the illustrated embodiment, the lock 158*a* is embodied as a pin 160*a* sized to pass through the locking aperture 150*a* in the beam 56 and an apertures 156 in the bar 152. The pin 160*a* may be held in engagement with the locking aperture 150*a* by any suitable retaining device such as a cotter pin or lynch pin. In the illustrated embodiment, a retaining clip 162*a* pivotally connected to the head 164 of the pin 160*a* retains the pin 160*a*. The retaining clip 162*a* may include an arm 166 extending from the head 164 toward the end 168 of the pin 160*a*. An aperture 170 formed in the arm 166 may receive the end 168 of the pin 160*a* to prevent removal of the pin 16. In some embodiments, the arm 166 may a be pair of resilient steel wires or clips and the aperture 170 may be formed by bends or punches therein.

In one embodiment, the stop 140 may have an aperture 142*c* formed in a wall 148*c* and sized to permit insertion of the lateral support 138 without excessive play. In some embodiments the upper end 165 of the beam 141 forming the stop 140 may be cut at an angle 146. The lateral support 138 may pass through an aperture 142*c* in the wall 148*c* of a beam 56 embodied as a boxed 'I' beam 141 and through an open ended notch 142*d*, or, in some embodiments, a closed aperture 142*d*.

A lock 158*b* may secure the lateral support 138 to the stop 140. The lock 158*b* may be embodied as a bolt, pin, or other elongate structure with a portion thereof having a uniform cross section. In the illustrated embodiment, the lock 158*b* is embodied as a pin 160*b* sized to pass through a locking aperture 150*b* in the beam 141 and the apertures 156 in the bar 152. The pin 160*b* may be held in engagement with the locking aperture 150*b* by any suitable retaining device such as a cotter pin, lynch pin, or quick-release latch. In the illustrated embodiment, a retaining clip 162*b* retains the pin 160*b*.

Figure 5:
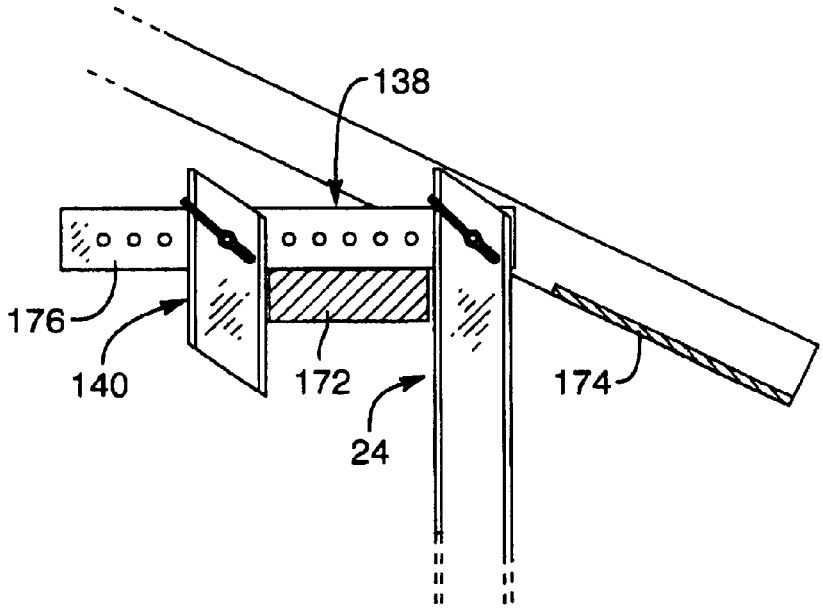
FIG. 5 is a side view of a hanger in operative engagement with support and roofing structures, in accordance with the invention.

Referring to FIG. 5, the adjustability of the stop 140 relative to the lateral support 138 is particularly useful when fitting the hanger 34 to a narrow support structure 172 with a soffit 174, or other such structure, forming an obstruction nearby. The lateral support 138 will in some instances be longer than the support structure 172 is wide in order to accommodate both narrow and wide support structures 172. Adjusting the leg 24 relative to the lateral support 138 will leave a portion of the lateral support 138 that in some instances will interfere with the soffit 174 fitted to overhanging rafters. Accordingly, the position of the stop 140 on the lateral support 138 may also be adjustable to accommodate walls of varying widths while avoiding interference with soffits. Making the position of the stop 140 adjustable may enable the extra portion 176 of the lateral support 138 to protrude away from the soffit 174 and into an unobstructed space.

Figure 6:
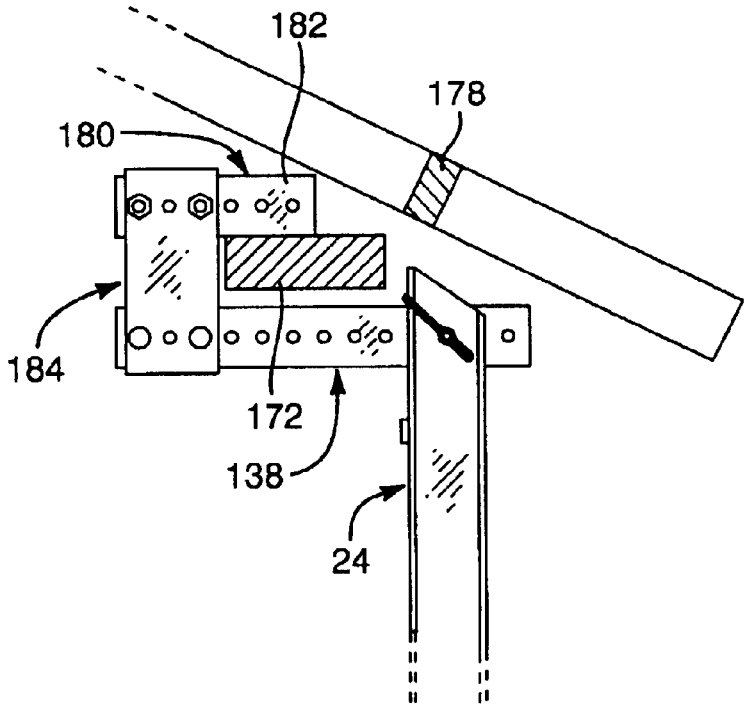
FIG. 6 is a side view of an alternative embodiment of a hanger in operative engagement with support and roofing structures, in accordance with the invention.

Referring to FIG. 6, an added obstacle to the placement of a hanger 34 may be a Frieze block 178 substantially limiting the open space above a support structure 172, such as the top of a wall or top plate of a wall. Accordingly the lateral support 138 may be positioned beneath a support structure 172 and a separate loading structure 180 such as a bar, hook, or any structure capable of bearing loads, may be used. In the illustrated embodiment, the loading structure 180 may be a bar 182. A spacer 184 may extend between the loading structure 180 and the lateral support 138. The spacer 184 may provide space for a support structure 172 between the loading structure 180 and the lateral support 138.

Figure 7:
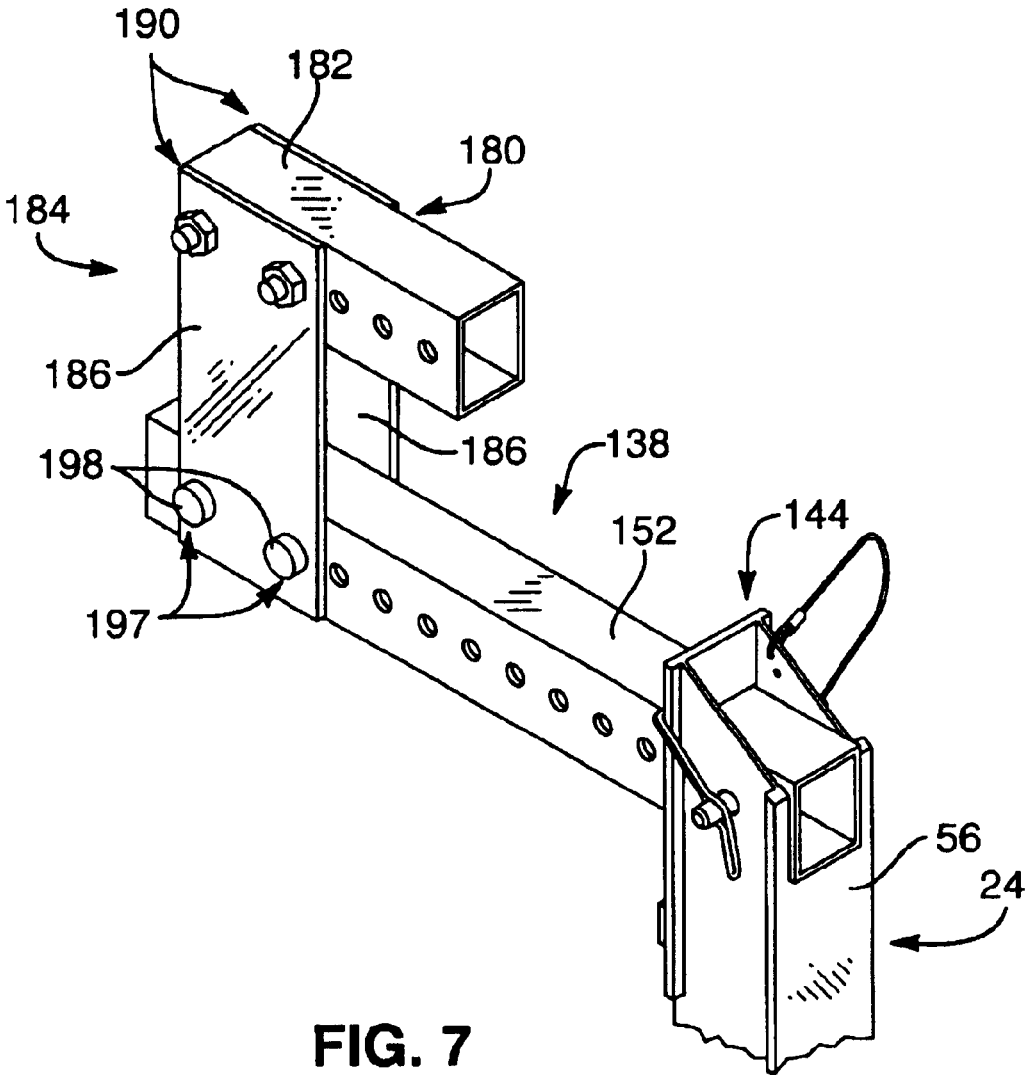
FIG. 7 is a perspective view of the hanger of FIG. 6.

Referring to FIG. 7, in some embodiments, the spacer 184 may be a plate 186, or plates 186 secured to both the lateral support 138 and the loading structure 180. In embodiments having two plates 186, the plates 186 may be placed on opposite sides of the loading structure 180. The plates 186 may have apertures 188 at their upper ends 190. The apertures 188 may receive bolts, welds, locking pins, or the like which may also pass through apertures 192 formed in the bar 182. In the illustrated embodiment, bolts 194 are used to secure the plates 186 to the bar 182. Locking pins held in place by cotter pins, retaining clips, or the like, may also be used to provide ready separation of the plates 186 from the bar 182.

The lower end 196 of the plates 186 may secure to the lateral support 138 by means of bolts, locking pins, welds, or the like. In the illustrated embodiment, the lower ends 196 of the plates 186 secure to the lateral support 138 by means of a lock 197. The lock 197 may either permanently, substantially permanently, or removably secure the lateral support 138 to the spacer 184. In the illustrated embodiment, the lock 197 is a locking pin 198 which may be held in place by lynch pins, cotter pins, retaining clips, or the like. The use of readily removable locking pins 198 may enable the distance between the spacer 184 and the leg 24 to be adjustable. In this manner the upper end 144 of the leg 24 extending above the lateral support 138 may be positioned near support structures of varying widths to serve as a stop 140, capturing a support structure 172 between itself and the spacer 184. Such adjustability may also be achieved by selective positioning of the leg 24 relative to the lateral support 138.

Alternatively, the spacer 184 and the loading structure 180 may be monolithically formed together or integrally or fixedly secured to one another. The spacer 184 may likewise be either integrally, monolithically, or fixedly secured to the lateral support 138.

Figure 8:
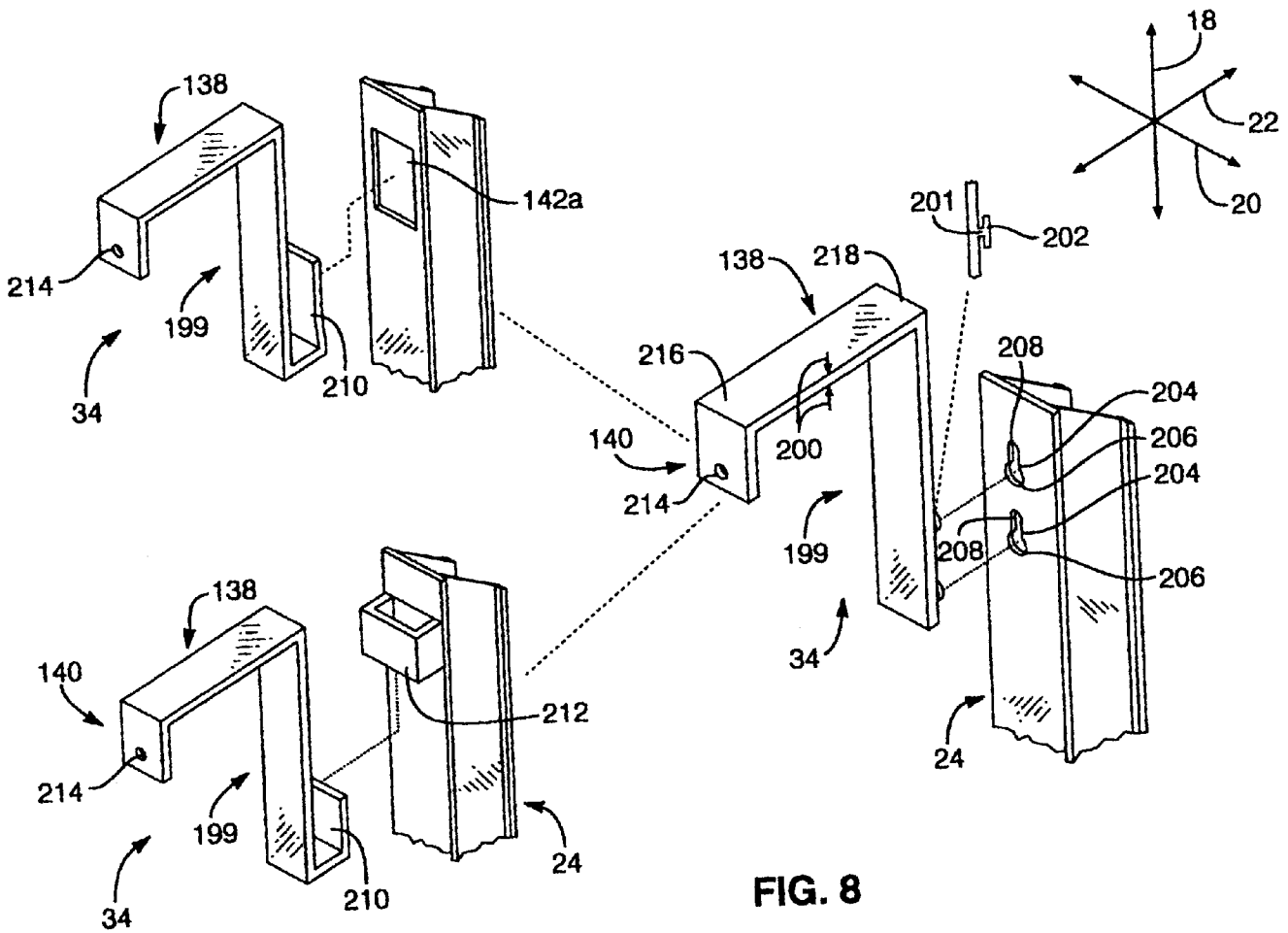
FIG. 8 is a perspective view of a removable hanger, in accordance with the invention.

Referring to FIG. 8, other embodiments for the hanger 34 may accommodate a Frieze block 178. For example, the stop 140 and the lateral support 138 may be monolithically, or integrally formed. A coupler 199 may be monolithically or integrally formed with the stop 140 and lateral support 138 to selectively secure the hanger 34 to the leg 24. The stop 140, lateral support 138, and coupler 199 may secure to one another by bolts, welds, pins, or any other suitably strong and tough fastening means.

In some embodiments, the stop 140, lateral support 138, and coupler 196 may be made of a strap of aluminum, steel, or other suitably resilient material, bent or formed in the shape of an inverted 'J.' The thickness 200 of the strap may be chosen to provide adequate stiffness and strength.

The coupler 199 may removably secure to the leg 24 by any suitable means. A removable hanger 34 may facilitate placement of a scaffold support 12 on top plates proximate Frieze blocks and the like. Removability may enable the hanger 34 to be inserted by approaching a top wall plate from either side. That is, the hanger 34 may be inserted into a gap between a Frieze block 178 and a support structure 172 from inside a building or from outside a building.

In the illustrated embodiment, a post 201 having a wide head 202 is secured to, or formed in the coupler 199. Multiple posts 201 may be formed on the coupler 199 to provide strength and stability. The posts 201 may engage slots 204 formed in the leg 24. The slots 204 may have a widened portion 206 to accommodate the insertion of the head 202. A post 200 may then be slid into engagement with a narrowed portion 208 where the head 202 will prevent removal of the post 200 from the slot 204 when subject to forces in the longitudinal direction 22.

Various alternative means are available to secure the hanger 34 to the leg 24. In some embodiments, the coupler 199 may include a hook 210, which may engage an aperture formed in the leg 24. In some embodiments, the hook 210 may be sized to engage an aperture 142*a*. In this manner, a leg 24 may engage both a coupler 199 and a lateral support 138 embodied as a bar 148. Alternatively, the hook 210 may engage an sleeve 212 or other receptacle formed on the leg 24 for engagement therewith of materials suitably strong to support the weight of the scaffold support 12 and any loads.

An aperture 214 may be provided in the stop 140 to secure the hanger 34 to a support structure 172. A nail, screw, or other fastener, may be driven through the aperture 214 into a support structure. Alternatively, a tie down or other fastener may pass through the aperture 214 and engage a support structure 172. Securing the stop 140 to a support structure may enable the corners 216, 218 of the hanger 34 to be hinged to facilitate insertion of the hanger 34 between a support structure 172 and a Frieze block 178, inasmuch as a nail or other fastener prevents removal of the hanger 34, rather than any reliance on the stiffness of the hanger 34 for that function.

Figure 9A:
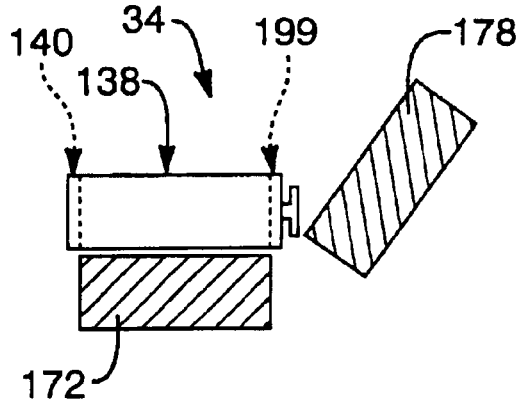
FIG. 9A is a side view of a removable hanger at one stage of deployment, in accordance with the invention.
Figure 9B:
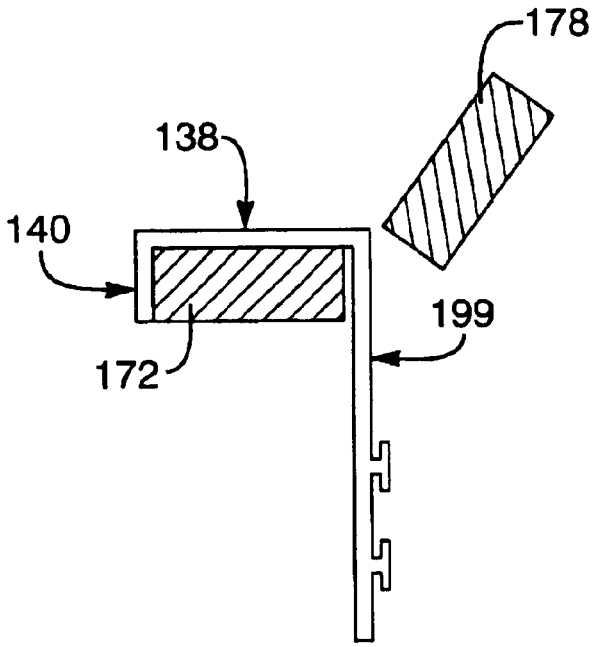
FIG. 9B is a side view of a removable hanger positioned to secure to a scaffold support in accordance with the invention.

Referring to FIG. 9A, a method for using a hanger 34 may include positioning the hanger 34 as shown with the coupler 199 parallel to a support structure 172. The coupler 199 may then be rotated down and between a Frieze block 178 and a support structure 172 as shown in FIG. 9B. A leg 24 may then secure to the coupler 199.

Figure 10:
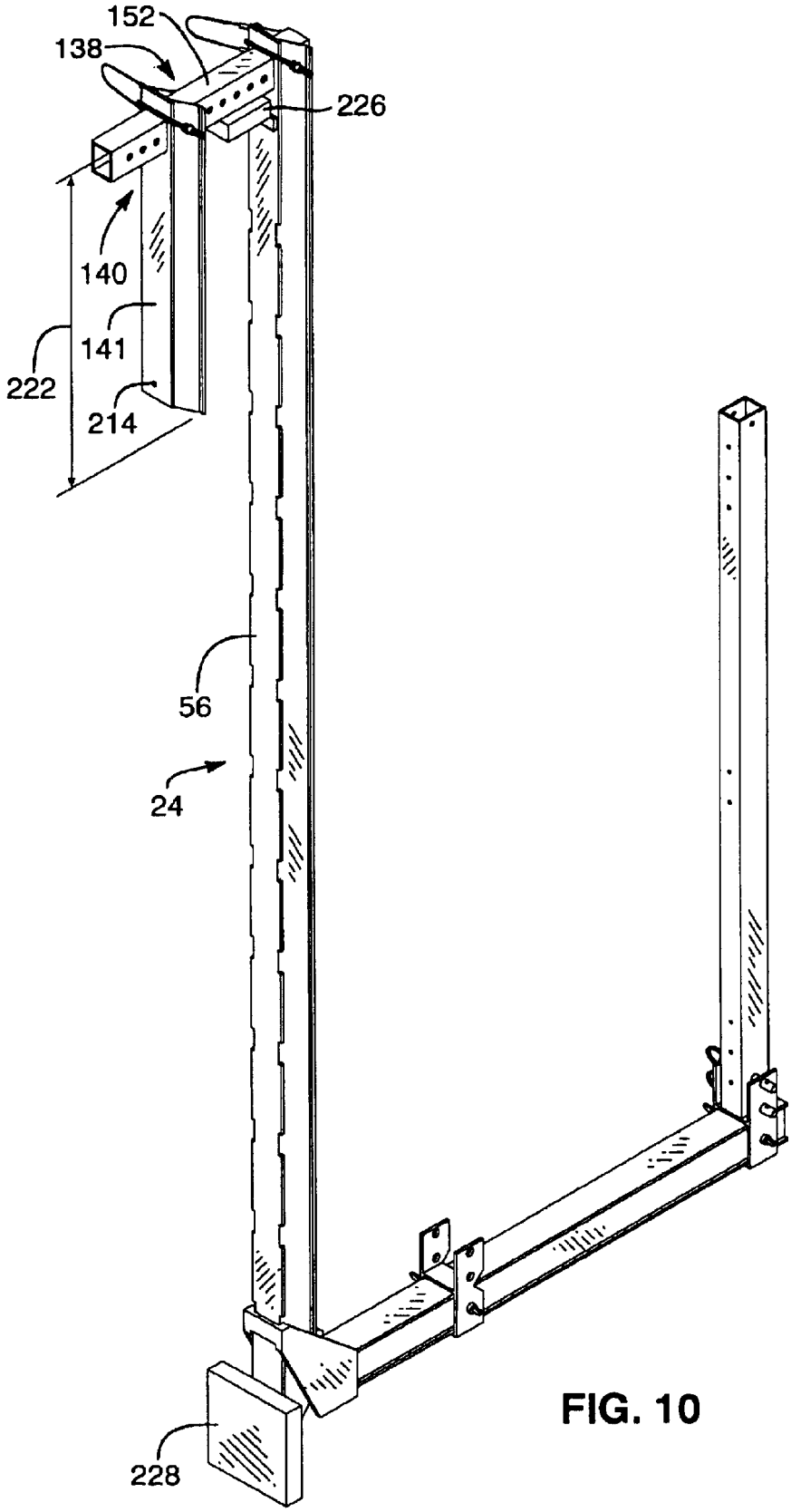
FIG. 10 is a perspective view of a scaffold support having an elongate stop in accordance with the invention.

Referring to FIG. 10, in some instances scaffolding is needed to perform repairs and improvements on finished walls where most points from which a scaffold support 12 might hang have been covered by finishing materials such as siding, a soffit, or the like. In such instances, a scaffold support 12 may secure to a window sill or the like. Securement to a window sill may present its own difficulties. For example, resting a lateral support 138 on a sill may damage metal frames, wood casings, paint or other finishes. Furthermore, a window sill will not have a rafter, Frieze block, or the like to resist accidental lifting of the hanger 34 therefrom.

Accordingly, the length 222 of the stop 140 may increase. The increased length 222 may prevent accidental removal, inasmuch as the scaffold support 12 would need to be lifted an improbable distance in order for it to tip off a window sill or the like. The increased length 222 may also make the stop 140 a more effective leveling arm. A nail driven through an aperture 214 may therefore have sufficient leverage to prevent the leg 24 from contacting finished siding on the outside of a building.

A pad 226 may be positioned between the lateral support 138 and a window sill to reduce or prevent cosmetic damage to the sill. A pad 228 may be positioned between the leg 24 and a wall to prevent cosmetic damage of siding or the like. The pads 226, 228 may be fixedly or removably attached to the lateral support 138 and leg 24. Alternatively, the weight of the lateral support 138 and leg 24 may maintain the positioning of the pads 226, 228. The pads 226, 228 may be made of rubber, leather, natural or synthetic woven fabric, expended polymer foams, or the like.

Figure 11:
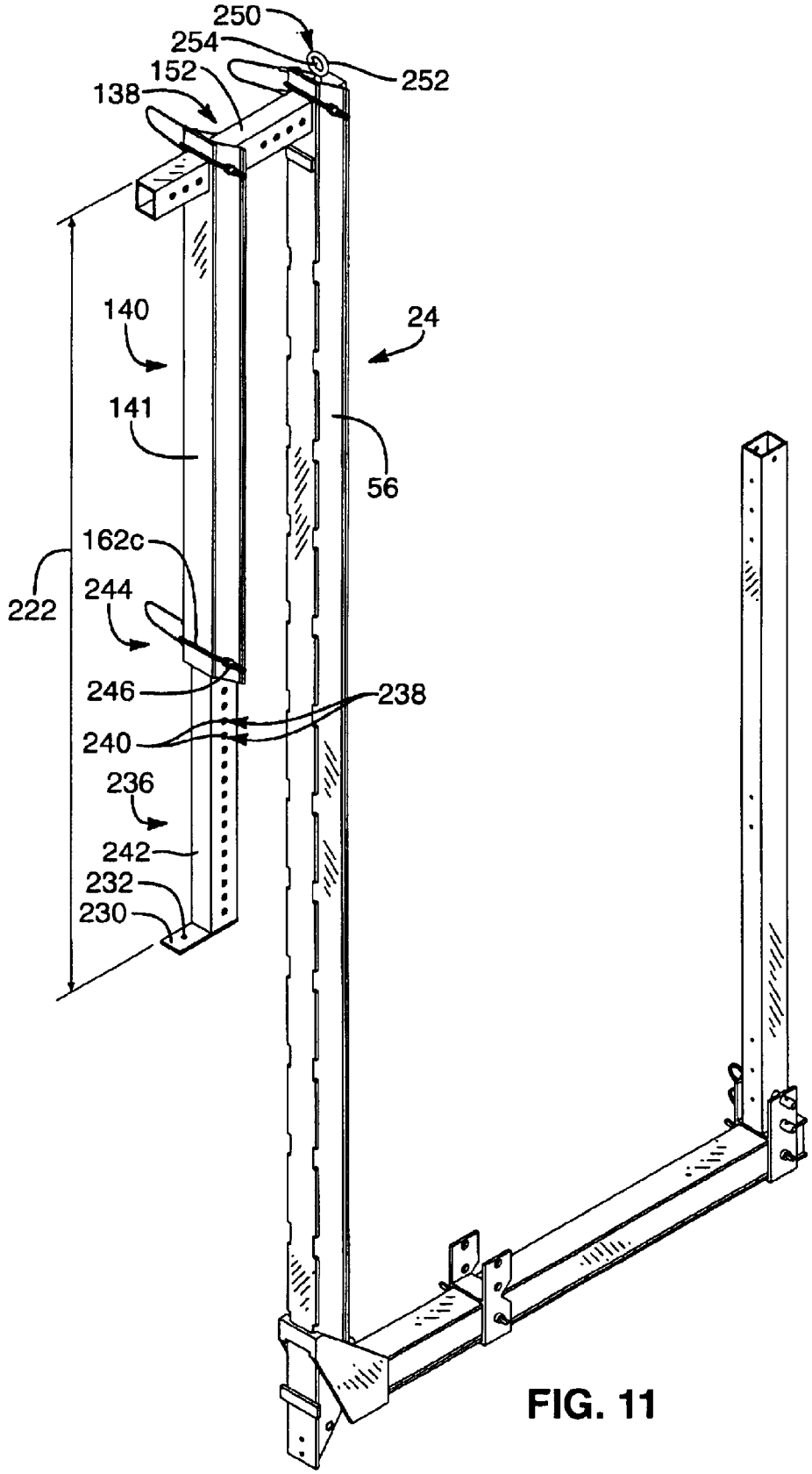
FIG. 11 is a perspective view of a scaffold support having a stop for resting on a floor, in accordance with the invention.

Referring to FIG. 11, in some uses of the apparatus 10, it may be impractical to drive a nail into a wall through an aperture 214. For example, an interior wall may be finished and likely to suffer cosmetic damage from driving a nail therethrough. Accordingly the length 222 may be further lengthened such that the stop 140 rests on the floor of a structure. The stop 140 may therefore serve as a stand 140 for supporting the scaffold support 12. A foot 230 may secure to the end of the stop 140 to provide a greater bearing surface resting on a floor in order to prevent damage, tipping, or other degrees of motion, A foot 230 may be a bar, tab, crossbar, flat plate, or the like made of metal, plastic, rubber, wood, or the like. The foot 230 may also be a rubber cap fit over the end of a stop 140. An aperture 232, or other such structure may be provided in a foot 230 to receive a fastener, such as a nail, for securing the foot 230 to a floor to resist the scaffold support 12 tipping, rocking, or sliding, and striking a finished exterior wall. Inasmuch as interior floors may be carpeted, driving a nail or screw into a floor may not cause cosmetic damage. In some embodiments the foot 230 may removably secure to the stop 140 so that a scaffold support 12 may be used in situations where a foot 230 is not necessary and is an obstruction. In some embodiments, a crossbeam fitted to padding may connect to, or even form, the connection to the lateral beam from which the leg suspends. Thus stability and protection may be provided at a window sill.

The distance between a window sill and a floor may vary with the size of the window and other design parameters. Accordingly, the length 222 may be adjustable to accommodate varying sill heights. An extension 236 may adjustably secure to the stop 140. In some embodiments, the extension 236 may have a series of registration structures 238 formed in, or secured to, the extension 236. The registration structures 238 may provide a surface or structure that may be gripped, or otherwise engaged, to fix the position of the extension 236 relative to the stop 140. In some embodiments, the registration structures 238 may be a series of apertures 240 formed in a beam 242 forming the extension 236. The beam 242 may be a box beam, 'I' beam, boxed 'I' beam, or the like.

A lock 244 may engage the registration structures 238. In some embodiments, the extension 236 may slide within the beam 141 forming the stop 140. The lock 244 may then be a pin 246, or the like, passing through an aperture 248 in the beam 141 and through one of the apertures 240. A retaining clip 162*c*, lynch pin, cotter pin, or the like may prevent removal of the pin 246.

Other structures may be used to provide an adjustable stop 140, or stand 30. For example the registration structures 238 may be formed on the stop 140 and the extension 236 secured at various positions along the stop 140. The apertures 248 may be replaced or augmented by grooves, posts, or other protruding structures.

A further improvement of a scaffold support 12 may be an eye 250 secured to the leg 24 to facilitate lowering of the apparatus 10. The eye 250 may be an eye bolt 252 having an aperture 254 formed therein to receive a rope, cable, tether, or the like. Alternatively, an aperture 254 may be formed in, or the eye bolt 252 secured to, the leg 24, lateral support 138, or stop 140.

Figure 12:
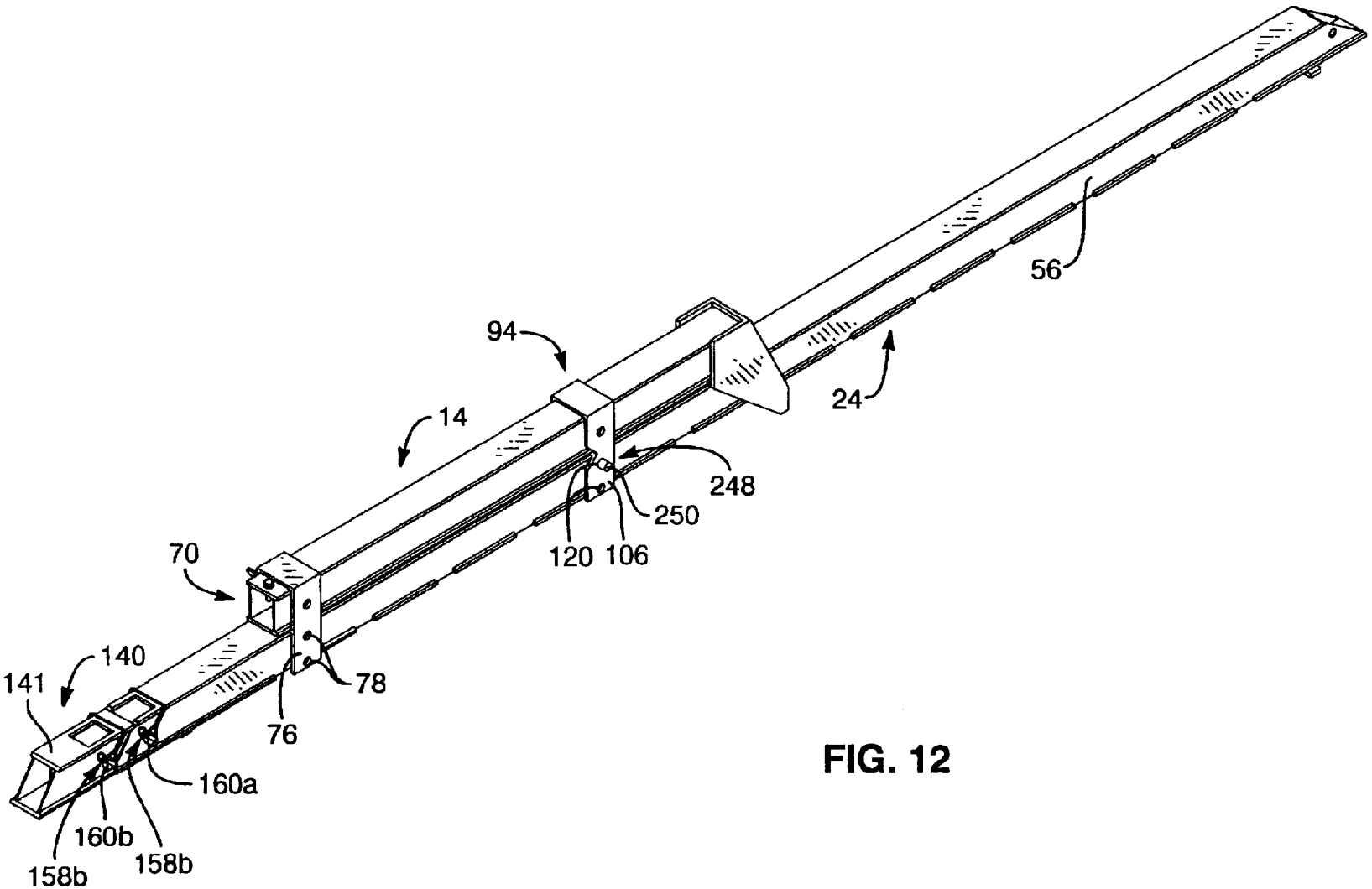
FIG. 12 is a perspective view of a scaffold support in a stowed configuration, in accordance with the invention.

Referring to FIG. 12, a scaffold support 12 may have both deployed and stowed configurations. A deployed scaffold support 12 may be in a configuration suitable for bearing a plank 96 and hanging on a wall structure, or the like. A stowed scaffold support 12 may position the components of the scaffold support 12 in a more compact configuration for easier stowage and transportation. A lock 248 may fix the components of the scaffold 12 in their stowed configuration.

The base 14 may be positioned to lie along the leg 24 with the flanges 106 of the stop 94 extending around the leg 24. The lock 248 may be formed by a locking pin 250 extending through apertures 110 formed in either flange 106 of a stop 94 and through an aperture formed in the leg 24. Alternatively, the lock 248 may be embodied as a locking pin 250 extending through apertures 78 in either flange 76 of the post mount 70. A portion of the lateral support 138 may be inserted into the stop 140 and locked in place using the lock 158*b* in embodiments of a stop 140 having a beam 141 which is a box beam or boxed 'I' beam providing a cavity for that purpose. A portion of the lateral support 138 may be inserted in the leg 24 and locked in place using a lock 158*a* for legs 24 having a beam 56 embodied as a box beam or boxed 'I' beam providing a cavity for that purpose. Of course, given the elongate shape of the components forming the scaffold support 12, various methods may be used to secure them to one another to form a single elongate assembly for ready storage and transport, such as tethers or brackets used exclusively to bind the scaffold support 12 in a stowed position.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for supporting a working deck for personnel, the apparatus comprising:

a hanging scaffold support comprising:

a foot extending substantially horizontally in a lateral direction between a heel portion and a toe portion, and a leg having an upper end and a lower end, the leg extending transversely in a substantially vertical direction from the upper end thereof toward the lower end to support the foot;

a hanger selectively securable proximate the upper end of the leg to extend therefrom substantially horizontally; and the hanger further comprising:

a lateral beam selectively securable to be laterally adjustable with respect to the leg to extend laterally away therefrom; and a stop selectively securable to be laterally adjustable with respect to the lateral beam.

2. The apparatus of claim 1, wherein the lateral beam further comprises a plurality of registration surfaces formed thereon, and the hanger further comprises a first lock and a second lock, the first lock selectively engaging the leg and at least one registration surface to fix the position of the leg relative to the lateral beam, the second lock selectively engaging the stop and the lateral beam to fix the position of the stop relative to the beam.

3. The apparatus of claim 2, wherein the registration surfaces comprise a portion of the lateral beam having adjustment apertures spaced apart therein, and the first and second locks comprise first and second pins, respectively, selectively inserted into the adjustment apertures.

4. The apparatus of claim 3, wherein the stop is a beam extending transversely and having a stop slide aperture to adjustably receive the lateral beam therethrough, the stop further provided with a locking aperture to selectively receive the second pin to fix the position of the stop relative to the lateral beam.

5. The apparatus of claim 4, wherein the leg is provided with a leg slide aperture extending laterally therethrough proximate the upper end thereof to selectively and adjustably receive the lateral beam, the leg further having a locking aperture to selectively receive the first pin therethrough to fix the lateral beam relative to the leg.

6. The apparatus of claim 5, further comprising:

a deck, a bracket secured to the foot proximate the toe portion, a catch positioned along the foot and having a receptacle for engaging an edge of the deck, a lock selectively fixing the position of the catch relative to the foot, and the deck positioned between the bracket and the catch to substantially limit rotation of the deck.

7. An apparatus for supporting a person on a working deck defining mutually orthogonal longitudinal, lateral, and transverse directions, the apparatus comprising:

a deck sized to support vertically a person standing thereon during movement longitudinally therealong;

a hanging scaffold support comprising:

a foot extending substantially laterally to support the deck, and a leg having an upper end and a lower end, and extending substantially transversely from the upper end toward the lower end to support the foot;

a hanger selectively securable proximate the upper end of the leg to extend therefrom substantially laterally;

the hanger further comprising:

a lateral beam selectively securable proximate a first end thereof to the leg to be laterally adjustable with respect thereto and to extend laterally away therefrom, and a stand selectively securable to the lateral beam proximate a second end thereof opposite the leg to extend substantially transversely from the lateral beam toward the lower end of the leg to support a vertical load.

8. The apparatus of claim 7, wherein the stand further comprises a static portion, an extension portion, and a lock selectively fixing the position of the extension portion relative to the static portion.

9. The apparatus of claim 8, wherein the extension portion includes a plurality of adjustment apertures, the static portion defines a locking aperture, and the lock comprises a pin selectively engaging the locking aperture and at least one of the plurality of adjustment apertures.

10. An apparatus for supporting a person on a working deck, the apparatus comprising:

a deck sized to support movement of a person horizontally therealong and to support vertically a person standing thereon;

a hanging scaffold support having a foot, extending substantially horizontally to support the deck, and a leg, having an upper end and a lower end, the leg extending substantially vertically from the upper end thereof toward the lower end to support the foot;

a hanger selectively securable proximate the upper end of the leg to extend therefrom substantially horizontally;

the hanger further comprising:

a lateral beam securing the leg to extend laterally away therefrom, a loading structure extending parallel to the lateral beam; and a spacer connecting the loading structure to the lateral beam in a spaced relation.

* * * * *